United States Patent [19]

Jamison

[11] 4,024,682

[45] May 24, 1977

[54] A-FRAME BUILDING

[76] Inventor: Billy H. Jamison, 1305 Blanton Drive, Sherman, Tex. 75090

[22] Filed: June 16, 1976

[21] Appl. No.: 696,694

[52] U.S. Cl. ..... 52/90; 52/294

[51] Int. Cl.[2] ..... E04B 1/48

[58] Field of Search ..... 52/90, 293, 294

[56] References Cited

UNITED STATES PATENTS

| | | | |
|---|---|---|---|
| 2,200,636 | 5/1940 | Palmer | 52/294 |
| 2,472,630 | 6/1949 | Stevenson | 52/90 |

*Primary Examiner*—John E. Murtagh

*Attorney, Agent, or Firm*—Richards, Harris & Medlock

[57] ABSTRACT

An A-frame building includes a plurality of angularly upwardly extending beams and a floor structure. The beams are interlocked at their upper ends and thus serve to support one another. Adjacent beams are interconnected by tongue and groove joints. The floor structure comprises a relatively thin central portion and relatively thick outer edge portions. The beams of the building extend into the edge portions of the floor structure and are thus secured in place.

10 Claims, 6 Drawing Figures

A-FRAME BUILDING

BACKGROUND AND SUMMARY OF THE INVENTION

This invention relates generally to improvements in A-frame building construction.

Although a wide variety of A-frame building designs have been proposed heretofore, the need persists for considerable improvement in the art. Thus, although one of the primary advantages thought to be provided by the A-frame building design concept is that of simplicity and therefore economy, many prior building designs of this type have in fact been complicated and thus costly. One characteristic of the type of complexity that is often found in prior art A-frame building designs involves the use of separate frame and roof/wall members. This necessitates very accurate construction of the frame in order that the roof/wall members will properly fit together. Many prior art A-frame building designs have also employed relatively complicated means of interconnecting either the frame or the roof/-wall members to the underlying floor structure.

The present invention comprises an A-frame building design which overcomes the foregoing and other disadvantages long since associated with the prior art. In accordance with the broader aspects of the invention, an A-frame building includes a plurality of beams which function as self-supporting roof/wall members. The beams are interlocked at their upper ends, and adjacent beams are interconnected to form a continuous roof/wall structure extending the entire length of the building.

The roof/wall structure of the A-frame building overlies a floor structure. The floor structure preferably comprises a concrete slab including a relatively thin, centrally disposed deck or flange portion and relatively thick edge or web portions extending along the opposite edges of the central portion. The beams comprising the roof/wall structure are received in the edge portions of the floor structure and are thus secured in place.

In accordance with more specific aspects of the invention, half of the upper end of each beam is removed to form a notch. The beams are arranged in opposed pairs with the remaining half of the upper end of each beam being received in the notch of the opposite beam. The notch of each beam is defined by a surface which engages the underside of the opposite beam, so that the beams are interlocked and self-supporting. Adjacent beams are preferably interconnected by tongue and groove joints.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
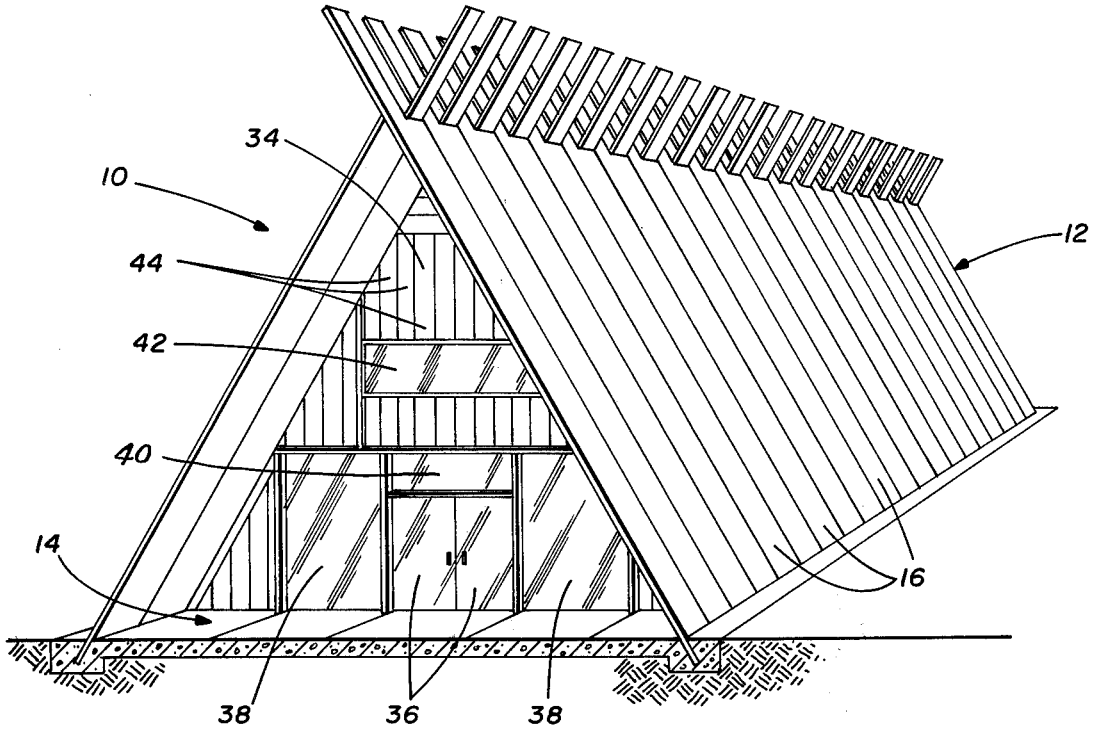
FIG. 1 is a perspective view of an A-frame building incorporating the invention.

Referring now to the Drawings, and particularly to FIG. 1 thereof, there is shown an A-frame building 10 incorporating the present invention. The A-frame building 10 includes a combined roof/wall structure 12 and a floor structure 14. Both the roof/wall structure 12 and the floor structure 14 extend continuously throughout the entire length of the A-frame building 10.

The roof/wall structure 12 of the A-frame building 10 comprises a plurality of identical beams 16. The beams 16 are preferably formed from wood, and may comprise one of the various types of wood commonly employed in the construction industry, such as redwood, cedar, pine, etc. Alternatively, the beams 16 may be formed from a composite material, such as plywood or the like.

Figure 2:
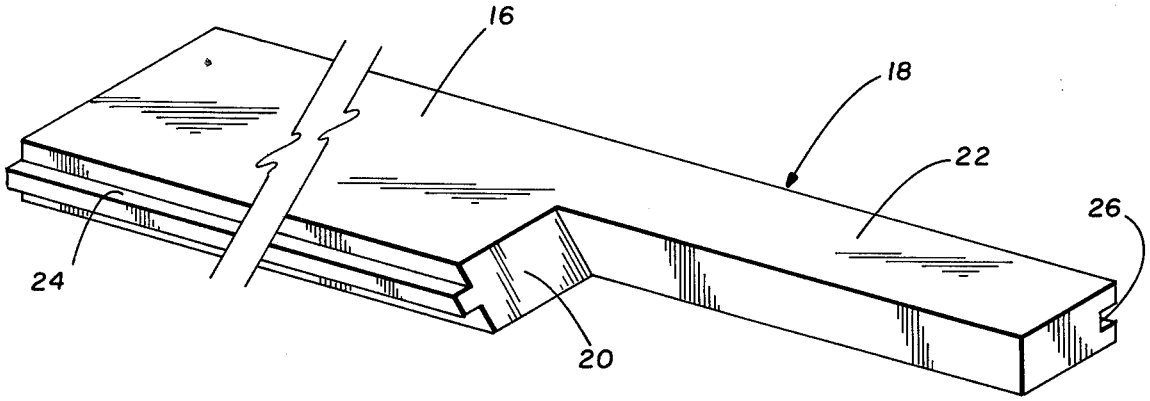
FIG. 2 is a perspective view of one of the beams of the building of FIG. 1.
Figure 3:
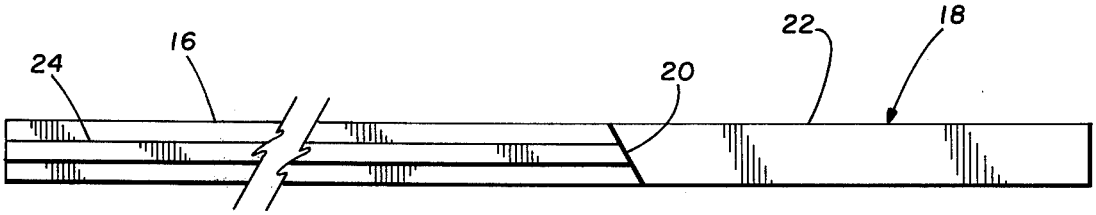
FIG. 3 is a side view of the beam.
Figure 4:
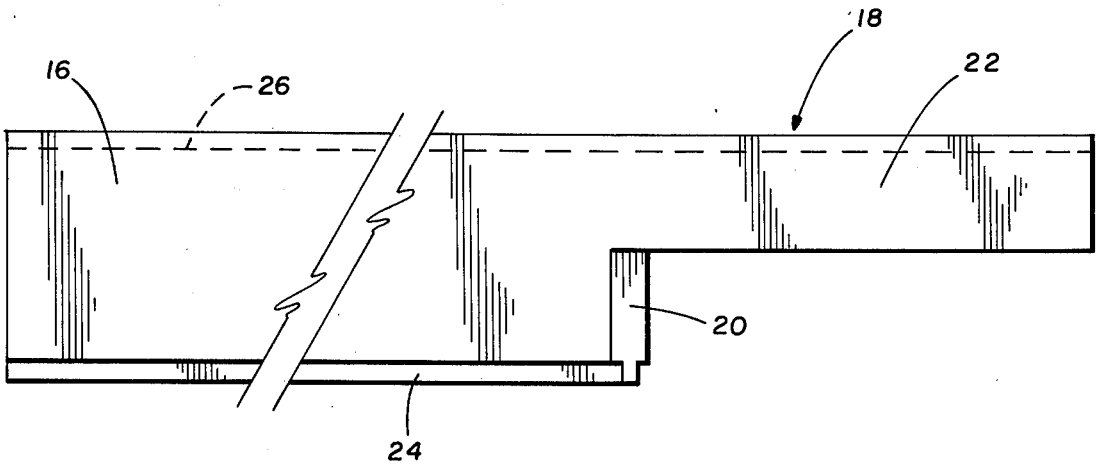
FIG. 4 is a top view of the beam.

Referring to FIGS. 2, 3 and 4, each beam 16 comprising the roof/wall structure 12 has one-half of the upper end thereof removed to form a notch 18. The notch 18 is defined by a surface 20 extending at a predetermined angle. The angle of the surface 20 is coincident with the angle of inclination of the beams 16 to the horizontal when the beams 16 are installed to form the roof/wall structure 12 as shown in FIG. 1.

Figure 5:
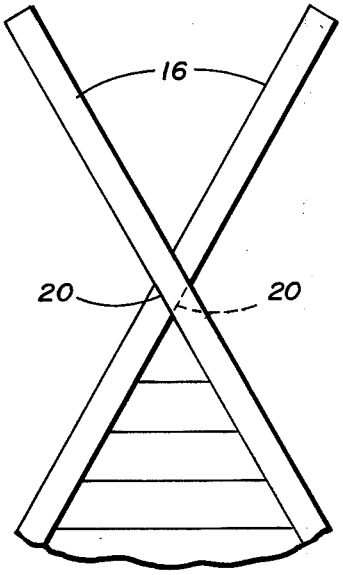
FIG. 5 is a partial end view showing the top of the A-frame building.

As is best shown in FIGS. 1 and 5, the A-frame building 10 is assembled with the beams 16 arranged in opposed pairs. Each beam 16 has an upper end 22 extending adjacent to the notch 18. The A-frame building 10 is constructed by positioning the upper end 22 of each beam in the notch 18 of the opposite beam. When the beams 16 are so arranged, the surface 20 of each beam engages the under surface of the opposite beam. In this manner the beams 16 are interlocked and function to support one another.

In forming the roof/wall structure 12, the beams 16 are positioned immediately adjacent one another, and are preferably interconnected. The beams 16 are preferably interconnected by means of tongue and groove joints, although other types of joints may also be used. Referring to FIGS 2, 3 and 4, tongue and groove joints between the beams 16 may be formed by providing each beam with a tongue 24 extending along one edge thereof and a groove 26 extending along the opposite edge thereof. It will be understood that the tongue 24 may be omitted from two of the endmost beams 16 comprising the roof/wall structure 12, and that the groove 26 may be omitted from the remaining two endmost beams 16 comprising the roof/wall structure 12, if desired.

Figure 6:
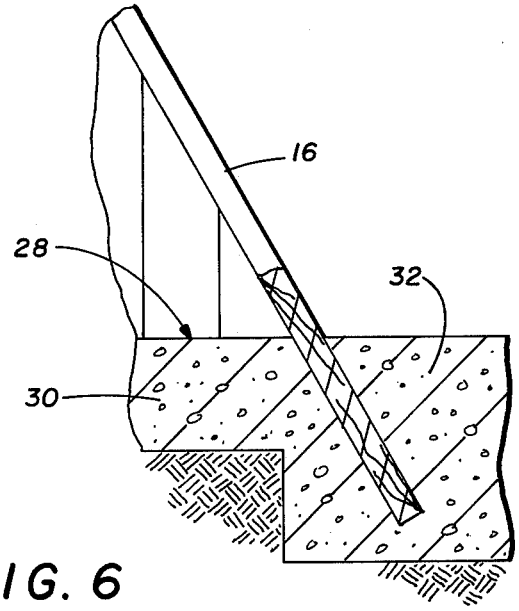
FIG. 6 is a sectional view showing the interconnection between the roof/wall structure and the floor structure of the building.

Referring now to FIG. 6, the floor structure of the A-frame building 10 preferably comprises a concrete slab 28. The slab 28 includes a relatively thin, centrally disposed flange or deck portion 30. Relatively thick web or edge portions 32 extend along the opposite edges of the web or deck portion 30. The edge portions 32 are preferably formed integrally with the deck portion 30, although other forms of construction may also be used.

The lower ends of the beams 16 comprising the roof/-wall structure 12 are preferably received in the edge portions 32 of the concrete slab 28 comprising the floor structure 14. By this means the beams 16 are rigidly secured in place. The A-frame building 10 may be constructed in this manner by first erecting the beams 16 to define the roof/wall structure 12, and then pouring the slab 28 comprising the floor structure 14 in such a way as to form the edge portions 32 around the lower ends of the beams 16. Alternatively, the concrete for the slab 28 may be formed first and the roof/wall structure 12 may subsequently be constructed prior to the setting of the concrete. This may be accomplished by positioning the lower ends of the beams 16 in the newly poured concrete which will form the edge portions 32 as the beams 16 are erected.

Referring again to FIG. 1, the A-frame building 10 further includes end walls 34. The end walls of the A-frame building 10 are preferably conventional in construction and design, and may include windows, doors, etc. in accordance with the requirements of a particular application of the invention. Thus, by way of example, the particular A-frame building 10 shown in FIG. 1 includes double doors 36, side windows 38, a transom window 40 and an upper window 42, together with wall panels 44. Other arrangements of doors, windows, and similar structures may be utilized in the end walls 34 of the A-frame building 10, as desired.

From the foregoing, it will be understood that the present invention comprises an A-frame building incorporating numerous advantages over the prior art. Thus, in accordance with the invention, an A-frame building is uncomplicated and straightforward in design, and is therefore economical to construct. By means of the invention, an A-frame building may be constructed entirely from prefabricated members, with the only on-site construction required being the pouring of the floor structure and the erection of the beams comprising the roof/wall structure. Another advantage deriving from the use of the invention involves the fact that by means thereof an A-frame building may be constructed without requiring the erection of a frame to support the roof/wall structure. Still another advantage involves the fact that by means of the invention the roof/wall structure and the underlying floor structure are interconnected in a straightforward and economical manner. Other advantages deriving from the use of the invention will readily suggest themselves to those skilled in the art.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. An A-frame building comprising:

a plurality of angularly upwardly disposed beams defining a roof/wall structure;

each beam having half of the upper end thereof removed to define a notch and an upper end portion of the beam extending adjacent to the notch;

the beams comprising the roof/wall structure being arranged in opposed pairs with the upper end portion of each beam being received in the notch of the opposite beam so that the beams are interlocking and self-supporting;

the notch of each beam being defined by a surface extending parallel to and positioned in engagement with the under surface of the opposite beam;

joint means interconnecting adjacent beams to define a continuous roof/wall structure;

a floor structure underlying the roof/wall structure and including at least cast members comprising end portions of the floor structure; and the lower ends of the beams defining the roof/wall structure being received in the cast structure of the end portions of the floor structure and thereby being secured in place.

2. The A-frame building according to claim 1 wherein each of the beams is formed from wood.

3. The A-frame building according to claim 1 wherein each of the beams is formed from plywood.

4. The A-frame building according to claim 1 wherein the joint means comprises tongue and groove joint means including interfitting tongues and grooves on adjacent beams comprising the roof/wall structure.

5. The A-frame building according to claim 1 wherein the floor structure comprises a concrete floor structure including a relatively thin, centrally disposed deck portion and integral, relatively thick edge portions extending along the opposite edges of the deck portion.

6. An A-frame building comprising:

a plurality of substantially identical angularly upwardly disposed beams defining a roof/wall structure;

half of the upper end of each beam being removed to define a notch and an upper end portion of the beam extending adjacent thereto;

the beams comprising the roof/wall structure being interfitted with the upper end portion of each beam being received in the notch of a cooperating beam whereby the roof/wall structure is self-supporting;

the lower end of the notch of each beam being defined by a surface extending parallel to and positioned in engagement with the upper end portion of the interfitting beam;

tongue and groove joint means interconnecting adjacent beams to define a continuous roof/wall structure;

a concrete floor structure underlying the roof/wall structure and including edge portions extending along the opposite edges thereof; and the lower ends of the beams defining the roof/wall structure being received in the edge portions of the floor structure and thereby being secured in place.

7. The A-frame building according to claim 6 wherein the edge portions of the floor structure are relatively thick, and wherein the floor structure further includes a relatively thin deck portion extending between the edge portions.

8. The A-frame building according to claim 7 wherein the tongue and groove joint means comprises interfitting tongues and grooves on adjacent beams.

9. The A-frame building according to claim 8 wherein the beams are formed from wood.

10. The A-frame building according to claim 8 wherein the beams are formed from plywood.

* * * * *